United States Patent [19]

Zinbo et al.

[11] Patent Number: 4,554,085

[45] Date of Patent: Nov. 19, 1985

[54] NON-METALLIC, ANTIOXIDANT, ANTIWEAR LUBRICANT ADDITIVE SYSTEM

[75] Inventors: Mikio Zinbo, Canton; Ronald K. Jensen, Trenton; Milton D. Johnson, Livonia, all of Mich.

[73] Assignee: Ford Motor Company, Dearborn, Mich.

[21] Appl. No.: 573,276

[22] Filed: Jan. 23, 1984

[51] Int. Cl.[4] ..... C10M 1/48

[52] U.S. Cl. ..... 252/46.6; 252/400.21

[58] Field of Search ..... 252/46.6, 400.21

[56] References Cited

U.S. PATENT DOCUMENTS

| | | | |
|---|---|---|---|
| 2,149,271 | 6/1936 | Butz | 252/46.6 |
| 2,441,496 | 5/1948 | Lincoln et al. | 252/46.6 |
| 2,443,264 | 6/1948 | Mikeska | 252/46.6 |
| 2,526,497 | 10/1950 | Mileska | 252/46.6 |
| 2,591,577 | 3/1950 | McDermott | 252/46.6 |
| 2,983,681 | 5/1961 | Crosby et al. | 252/46.4 |
| 3,687,848 | 8/1972 | Colclough et al. | 252/32.7 E |
| 3,770,854 | 11/1973 | Morris et al. | 260/985 |

*Primary Examiner*—Jacqueline V. Howard

*Attorney, Agent, or Firm*—Lorraine S. Melotik; Roger L. May

[57] ABSTRACT

This invention is directed to a lubricating oil composition comprising a non-metallic antioxidant antiwear additive system comprising particular organic disulfide compounds and trivalent organophosphorous compounds.

7 Claims, No Drawings

NON-METALLIC, ANTIOXIDANT, ANTIWEAR LUBRICANT ADDITIVE SYSTEM

TECHNICAL FIELD

This invention relates to lubricating oils which contain a non-metallic antioxidant, antiwear additive mixture comprising particular organic disulfide compounds and trivalent organophosphorus compounds. More particularly, the disulfide compounds are selected from compounds having the chemical formula: $[(RO)_2PS]_2S_2$, wherein R is an organic group; and the trivalent organophosphorus compounds are selected from compounds (i) having the chemical formula: $Y_3P$, wherein Y is R' or R'O, wherein each R' is the same or different organic group, and (ii) having a boiling point above about 150° C.

BACKGROUND OF THE INVENTION

Lubricating oils used in internal combustion engines are subject to deterioration in the presence of oxygen. Oxidation of these oils eventually leads to the formation of sludge and varnish materials which deposit upon the various engine parts. These deposits result in ring sticking, poor heat radiation, and reduced lubrication which causes accelerated wear and eventual engine failure. Attempts to combat these problems include the addition of antiwear and antioxidant agents to the oil. Lincoln, in U.S. Pat. No. 2,441,496, teaches that a combination of sulfurized monomer olefins and organic phosphorus compounds, when added to lubricating oils, act to limit oxidation and corrosion as well as increase the film strength of the oil. Increased film strength of the oils allows smaller bearing areas to support the same or heavier loads without the danger of the oil being squeezed from between the rubbing surfaces. Makeska, in U.S. Pat. No. 2,443,264 employs organic compounds containing both phophorus and sulfur in mineral lubricating oils as inhibitors of oxidation and as agents for promoting engine cleanliness generally. Crosby et al, in U.S. Pat. No. 2,983,681, disclose lubricating oil compositions containing a combination of sulfurized isoprenoid compounds and organophosphorus, organoarsenic or organoantimony compounds, which are added to provide the lubricant with improved antiwear properties and oxidation stability. Additionally, Colclough et al, in U.S. Pat. No. 3,687,848, incorporate into a lubricating oil, an antioxidant and antiwear additive mixture of a particular phosphorothionyl or phosphonyl sulphide with an organic ammonium thiophosphate.

Presently, one of the most commonly employed lubricating oil additives is zinc dialkyldithiophosphate (ZDTP). This multifunctional lubricant additive was initially added to automobile lubricants as an antioxidant, but now is more widely used as an antiwear additive. However, recent studies have indicated that the combined presence of both zinc and phosphorus in automobile exhaust, which results from the decomposition and use of ZDTP, decreases the longevity of catalytic converters on automobiles.

DISCLOSURE OF THE INVENTION

The invention of this application is directed to a lubricating oil composition comprising a non-metallic, antioxidant, antiwear additive system. The lubricating composition comprises a major proportion of lubricating base oil and an additive system which comprises a mixture of:

(A) organic disulfide compounds selected from the group of compounds having the chemical formula: $[(RO)_2PS]_2S_2$, wherein R is an organic group; and (B) trivalent organophosphorus compounds selected from the group of compounds (i) having the chemical formula: $Y_3P$, wherein, Y is R'—or R'O—, and wherein each R' is the same or different organic group, and (ii) having a boiling point above about 150° C.

The disulfide compounds (A) are present in the oil composition in a concentration of at least 0.01 molar, and the molar ratio of B:A in the oil composition is from about 0.1 to 1.5:1. Preferably, the disulfide compounds are present in the oil composition in a concentration of from about 0.02 to 0.1 molar, and most preferably, the molar ratio of B:A in the oil composition is about 1:1.

Advantageously, the antioxidant-antiwear additive mixture of this invention is as effective as widely employed ZDTP additives and eliminates the inactivation of catalysts employed in anti-pollution devices of automobiles caused by zinc compound coatings.

It has been found that the disulfides and organophosphorus compounds of this invention, when employed singly in lubricants, are less effective than the ZDTP additives. However, when employed together in an oil, they appear to produce a synergistic effect in terms of antioxidant-antiwear action, which makes the combination comparable to that provided by the ZDTP additives.

Applicants believe that effective antioxidant-antiwear lubricant additives release organic species with (i) reactive acidic functional groups, and (ii) lubricant compatible hydrocarbon moieties under lubrication conditions. Applicants have found that the disulfide compounds (DS) and organophosphorus compounds ($Y_3P$) of this invention, in polar media, react in establishing equilibrium between a DS-$Y_3P$ mixture and a DS-$Y_3P$(1:1) ionic complex, which decomposes to acidic species having very effective antioxidant and antiwear properties. In essence, the complex is used as an effective chemical storage for these antioxidant and antiwear species. While the widely utilized zinc salts of dialkyl dithiophosphoric acids (ZDTP) are also precursors of such acidic species, it has been found that the antioxidant activities of some of the acidic species of applicants' invention, i.e., disubstituted 2-propyl, butyl, and octyl dithiophosphoric acids (DTPH), are very much greater than those of ZDTP. Neither the validity nor the understanding of the concepts just proposed are required for the practice of the invention described in this application.

BEST MODE FOR CARRYING OUT THE INVENTION

As described above, this invention relates to lubricating oil compositions comprising lubricating base oils, such as automotive engine oils, gear oils, transmission fluids, and metal working fluids, which contain a non-metallic antioxidant, antiwear additive mixture which comprises particular organic disulfide compounds and trivalent organophosphorus compounds. The lubricating oil base stocks used in this invention may be synthetic oils, straight mineral lubricating oils or distillates derived from paraffinic, naphthenic, asphaltic or mixed base crudes, or, if desired, various blends of these oils may be employed. These additives as well as optional materials which may be incorporated into the lubricating oil composition will be discussed hereinafter in greater detail.

The organic disulfide compounds which are employed in the additive mixture of this invention are selected from the compounds having the chemical formula: $[(RO)_2PS]_2S_2$, wherein R is an organic group. More particularly, R may be an aliphatic, aromatic or aliphatic-aromatic radical, preferably comprising from about three—twelve carbon atoms. The radical R is preferably a hydrocarbon group, which may be alkyl, aryl, alkaryl or aralkyl and may contain any of a variety of substituent groups in place of one or more hydrogen atoms. Exemplary of the various substituents or groups which may be present in R are alkyl, aryl, alkoxy, carboxy, hydroxy, mercapto, nitro, amino, aldo, keto, ester, and halogen substituted hydrocarbon groups, as well as halogen atoms. As would be apparent to one skilled in the art, selection of optimal disulfides to be employed in a particular lubricating base oil would be dependent, e.g., on optimal compatability of the organic group, R, of the disulfide with the base oil. For example, R of the organic disulfide compounds employed in hydrocarbon base stocks, would most preferably be a $C_4$–$C_8$ linear aliphatic radical.

Exemplary of the various disulfides which may be employed in the additive mixture of this invention are di-2-propyldithiophosphoryl, dipropyldithiophosphoryl, di-2-methyl-1-pyopyldithiophosphoryl, dibutyldithiophosphoryl, dioctyldithiophosphoryl, diphenyldithiophosphoryl and di-4-dodecyl-1-phenyldithiophosphoryl disulfide.

As would be apparent to one skilled in the art, mixtures of such disulfides are also suitable as the disulfide component for use in this invention.

Typically these disulfides may be prepared by processes which include reacting hydrogen peroxide with disubstituted (alkyl or aryl) dithiophosphoric acid at ambient temperature or below. Alternately, these disulfides may be prepared from potassium or ammonium salt of DTPH, which is first neutralized with dilute sulfuric acid to DTPH. The DTPH is converted to the corresponding disulfide by the above processes.

The other component of the additive mixture of this invention comprises trivalent organophosphorus compounds (i) having a boiling point above about 150° C. and (ii) being selected from compounds having the general formula: $Y_3P$, wherein Y is R′—or R′O—; wherein each R′ is the same or different organic group. More particularly, R′ may be any aliphatic, aromatic, or aliphatic-aromatic radical, and may be selected from any of the R groups described previously in this application for the disulfide. These trivalent organophosphorus compounds are selected from phosphines and phosphites including, but not limited to, tri-2-propylphosphine, tributylphosphine, trioctylphosphine, methyldiphenylphosphine, ethyldiphenylphosphine, triphenylphosphine, tri-2-propyl phosphite, tributyl phosphite, trioctyl phosphite, tris(2-chloroethyl) phosphite, tripolyl phosphite, tricresyl phosphite, methyl diphenyl phosphite, and triphenyl phosphite; with phenyl and substituted phenyl phosphites being most preferred. Materials of this type are commercially available from, for example, Aldrich Chemical Co. (Milwaukee, Wis.) and M&T Chemicals Inc. (Rahway, N.J.).

Mixtures of these organophosphorus compounds would also be suitable as the organophosphorus component in this invention.

The disulfide compounds are present in the composition in a concentration of at least 0.01 molar, more preferably, in a concentration of from about 0.02 to 0.1 molar and most preferably from 0.02 to 0.05 molar. Additionally, the molar ratio of B:A, i.e., trivalent organophosphorus compounds to disulfide compounds, in the composition is about 0.1-1.5:1. More preferably, the molar ratio of B:A in the oil composition is from about 0.5-1:1, most preferably this ratio is about 1:1.

The disulfide compounds and organophosphorus compounds of this invention may be incorporated into the base oil with or without prior solvent treatment. If solvent pretreatment is desired, the organic disulfides and trivalent organophosphorus compounds may be combined together in an inert organic polar solvent, or a mixture of inert organic solvents, at least one of which is polar, to dissolve the mixture. By means of the dissolution process, at least a part of the organic disulfides and organophosphorus compounds react and form their ionic complex. The solvent is subsequently stripped, e.g., under vacuum, to provide a solvent-free mixture which may then be added to the lubricating base oil. While the additive mixture may be prereacted in solvent prior to inclusion in the base oils, as has been stated above, no such pretreatment is necessary, i.e., the components may be added directly to the base oils, without having been pretreated in solvent, whereby the additive complex may be formed during the use of the lubricating oil composition. In those embodiments of this invention whereby the additive mixture is prereacted in solvent as previously described, the molar concentrations of the organic disulfides and organophosphorus compounds in the oil composition are taken to be the individual molar concentration of each additive as if no such pretreatment of the additive mixture had taken place. As would be apparent to one skilled in the art, in either case (i.e., of solvent pretreatment or non-pretreatment of the additives) the additive may be incorporated into the total volume of base oil or may be incorporated into a portion of the base oil to form a mixture which is then admixed into the remainder of the base oil forming the desired additive concentration.

Optionally, the lubricating oil composition may comprise other additives which are conventional to such compositions. Exemplary of such additives are pour point depressants, viscosity index improvers, detergents, dispersants, foam depressants, and, of course, chain-breaking antioxidants.

The invention will be further understood by referring to the following detailed examples. It should be understood that the subject examples are presented by way of illustration and not by way of limitation.

EXAMPLES

The antioxidant and antiwear activities of some exemplary additive mixtures of this invention are examined by (i) a batch reactor oxidation test and (ii) a four-ball wear test. Reference additive systems were also examined. The molar concentration of the additives in the oil composition is denoted in parentheses following the additives. The concise test procedures are given below together with the test results obtained for the various additive mixtures.

(i) Batch reactor oxidation test. Forty milliliters of purified hexadecane were placed in the reactor and purged with argon. When the hydrocarbon reached 160° C., known amounts of the additive components, either prereacted or non-prereacted, were added. Prereacted mixtures were prereacted in acetone. Aliquots (1 ml) were withdrawn at various reaction times (100 to 40,000 sec.) and analyzed for total $C_{16}$-monofunctional oxidation products by gas chromatography. An inhibition period, which is a measure of antioxidant activity, i.e., a longer inhibition period indicates more effective antioxidant activity, was obtained from a plot of the concentration of total $C_{16}$-monofunctional oxidation products vs. reaction time. Precision of the test procedure is within ±5%.

Some of the inhibition periods obtained for reference additive systems are as follows: zinc dioctyldithiophosphate (0.01M), 3,700 sec.; dioctyldithiohosphoric acid (0.02M), 15,500 sec.; dioctyldithiophosphoryl disulfide (0.01M), 2,500 sec.; triphenylphosphine (0.01M), 450 sec.; triphenyl phosphite (0.01M), 800 sec.

The inhibition periods obtained for three example mixtures are: triphenylphosphine-dioctyldithiophosphoryl disulfide (0.005M-0.01M, prereacted), 3,200 sec.; triphenylphosphine-dioctyldithiophosphoryl disulfide (0.01M-0.01M, prereacted) 2,600 sec.; triphenyl phosphite-dioctyldithiophosphoryl disulfide (0.01M-0.01M, non-prereacted), 3,400 sec.

Inhibition periods estimated for four example mixtures are: triphenylphosphine-dibutyldithiophosphoryl disulfide (0.02M-0.02M), 6,600 sec.; triphenylphosphine-diisopropyldithiophosphoryl disulfide (0.02M-0.02M), 6,200 sec.; triphenyl phosphite-dibutyldithiophosphoryl disulfide (0.02M-0.02M), 6,800 sec.; triphenyl phosphite-diisopropyldithiophosphoryl disulfide (0.02M-0.02M), 6,400 sec.

(ii)Four-ball wear test. Wear tests were conducted using a Roxana Four-Ball apparatus (South Roxana, Ill.) at 100° C. and 600 rpm for 60 min. under a 40-kg load. The wear specimens were AISI 52100 steel balls (grade 25). Test solutions were prepared by adding known amounts of the additive components, either prereacted as above or non-prereacted, to a Mobil hydrocarbon base oil (Princeton, N.J.). After the termination of the tests, the wear volumes of the three stationary balls were determined for the antiwear activity of the additive mixtures by measuring the wear scar diameter at various depths and calculating the volume as the sum of a series of cylinders. An estimated error range of the test is within $\pm 0.4\times 10^{-6}cm^3$.

Some of the wear volumes obtained for reference additive systems are as follows (wear volume in a unit of $10^{-6}cm^3$): zinc dioctyldithiophosphate (0.02M), 0.2; dioctyldithiophosphoric acid (0.02M), 2.0; dioctyldithiophosphoryl disulfide (0.02M), 1.5; triphenylphosphine (0.02M), 3.9; triphenyl phosphite (0.01M), 0.3.

The wear, volumes obtained for three example mixtures are wear volume in a unit of $10^{-6}cm^3$): triphenylphosphine-dioctyldithiophosphoryl disulfide (0.02M-0.02M, prereacted), 0.7; triphenylphosphine-dioctyldithiophosphoryl disulfide (0.01M-0.02M, non-prereacted), 0.7; triphenyl phosphite-dioctyldithiophosphoryl disulfide (0.01M-0.02M, non-prereacted 0.5).

Wear volumes estimated for four example mixtures are wear, volume in a unit of $10^{-6}cm^3$): triphenylphosphine-dibutyldithiophosphoryl disulfide (0.02M-0.02M), 0.4; triphenylphosphine-diisopropyldithiophosphoryl disulfide (0.02M-0.02M), 0.6; triphenyl phosphite dibutyldithiophosphoryl disulfide (0.02M-0.02M), 0.3; triphenyl phosphite-diisopropyldithiophosphoryl disulfide (0.02M-0.02M), 0.5.

In view of the disclosure, many modifications of this invention will be apparent to those skilled in the art. It is intended that all such modifications which fall within the true scope of this invention be included within the terms of the appended claims.

We claim:

1. A lubricating oil composition comprising a major proportion of a lubricating base oil and an additive system which comprises, in equilibrium:

I. a mixture of:

(A) organic disulfide compounds selected from the group of compounds having the chemical formula: $[(RO)_2PS]_2S_2$, wherein R is organic group; and (B) trivalent organophorphorous compounds (i) having a boiling point above about 150° C. and (ii) being selected from the group of compounds having the chemical formula $Y_3P$, wherein Y is R′—or R′O—, and wherein each R′ is the same or different organic group, said R and R′ being individually selected from substituted or non-substituted organic groups comprising aliphatic, aromatic or aliphatic aromatic radicals, and II. an ionic complex consisting of 1:1 molar reaction product of A and B, which decomposes to acidic species having antiwear and antioxidant properties, wherein said disulfide compounds are present in said composition in a concentration of at least about 0.01 molar, and the molar ratio of (B):(A) in said composition is from about 0.1-1.5:1.

2. A lubricating oil composition according to claim 1, wherein said radicals contain from about 3 to 12 carbon atoms.

3. A lubricating oil composition according to claim 2, wherein R and each R′ are the same or different hydrocarbon groups.

4. A lubricating oil composition according to claim 2, wherein each R′ is the same or different substituted or unsubstituted phenyl group.

5. A lubricating oil composition according to claim 1, wherein said disulfide compounds are present in said oil composition in a concentration of from about 0.02 to about 0.1 molar.

6. A lubricating oil composition according to claim 1, wherein the molar ratio of (B):(A) in said oil composition is about 0.5-1:1.

7. A lubricating oil composition according to claim 6, wherein the molar ratio of (B):(A) in said oil composition is about 1:1.

* * * * *